US007513740B1

(12) United States Patent
Hervy et al.

(10) Patent No.: US 7,513,740 B1
(45) Date of Patent: Apr. 7, 2009

(54) TURBINE RING

(75) Inventors: Nicolas Hervy, Draveil (FR); Marc Marchi, Le Mee (FR); Ludovic Nicollas, Vaux le Penil (FR)

(73) Assignee: SNECMA, Paris (FR)

( * ) Notice: Subject to any disclaimer, the term of this patent is extended or adjusted under 35 U.S.C. 154(b) by 522 days.

(21) Appl. No.: 11/103,539

(22) Filed: Apr. 12, 2005

(30) Foreign Application Priority Data

Apr. 15, 2004 (FR) ..... 04 03925

(51) Int. Cl.
*F01D 25/00* (2006.01)

(52) U.S. Cl. ..... 415/173.1; 416/191

(58) Field of Classification Search ..... 415/173.1, 415/173.4, 174.4; 416/191, 192; 277/631, 277/632, 641, 644
See application file for complete search history.

(56) References Cited

U.S. PATENT DOCUMENTS 5,088,888 A * 2/1992 Bobo ..... 415/170.1
5,127,793 A * 7/1992 Walker et al. ..... 415/115
5,997,247 A * 12/1999 Arraitz et al. ..... 415/139
6,575,697 B1 6/2003 Arilla et al.
6,814,538 B2 * 11/2004 Thompson ..... 415/116

FOREIGN PATENT DOCUMENTS

EP 1 162 346 A2 12/2001

* cited by examiner

*Primary Examiner*—Ninh H Nguyen
(74) *Attorney, Agent, or Firm*—Oblon, Spivak, McClellland, Maier & Neustadt, P.C.

(57) ABSTRACT

A turbine ring made up of an assembly of a plurality of sectors forming the outer shroud of the rotor of said turbine. The sectors are united end to end with interposed sealing systems comprising tongues housed in slots, said tongues being rectilinear and engaged in respective rectilinear slots in the radial faces of said sectors.

19 Claims, 2 Drawing Sheets

FIG.1
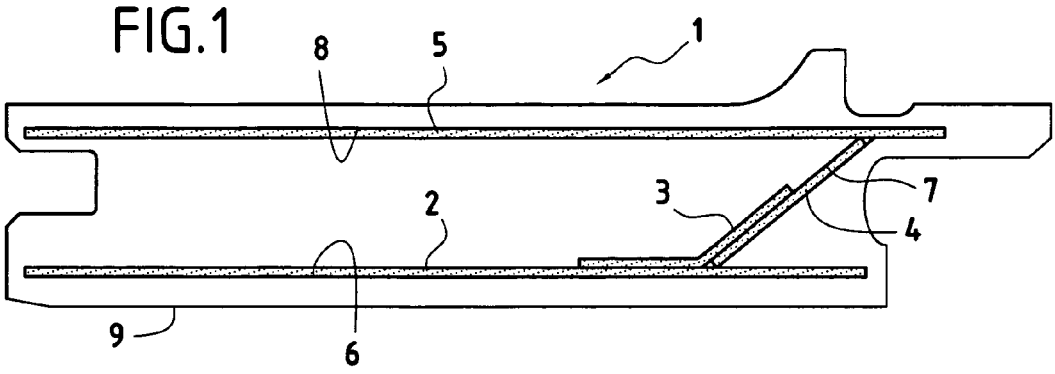
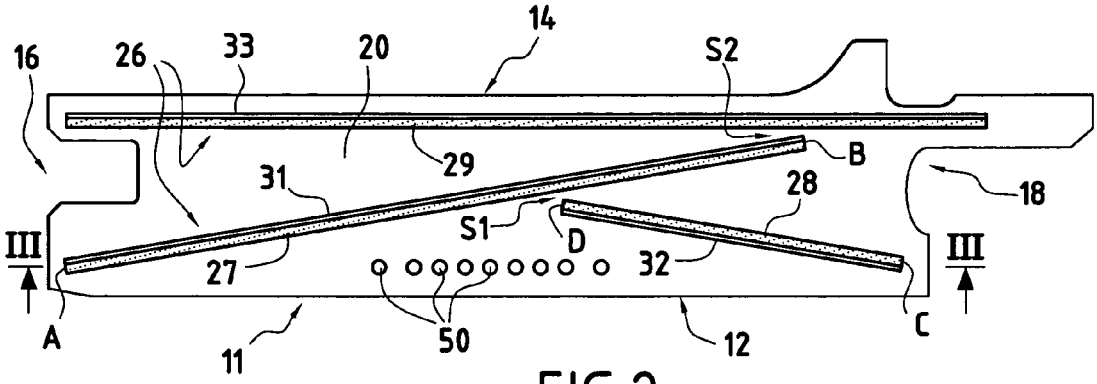
FIG.2
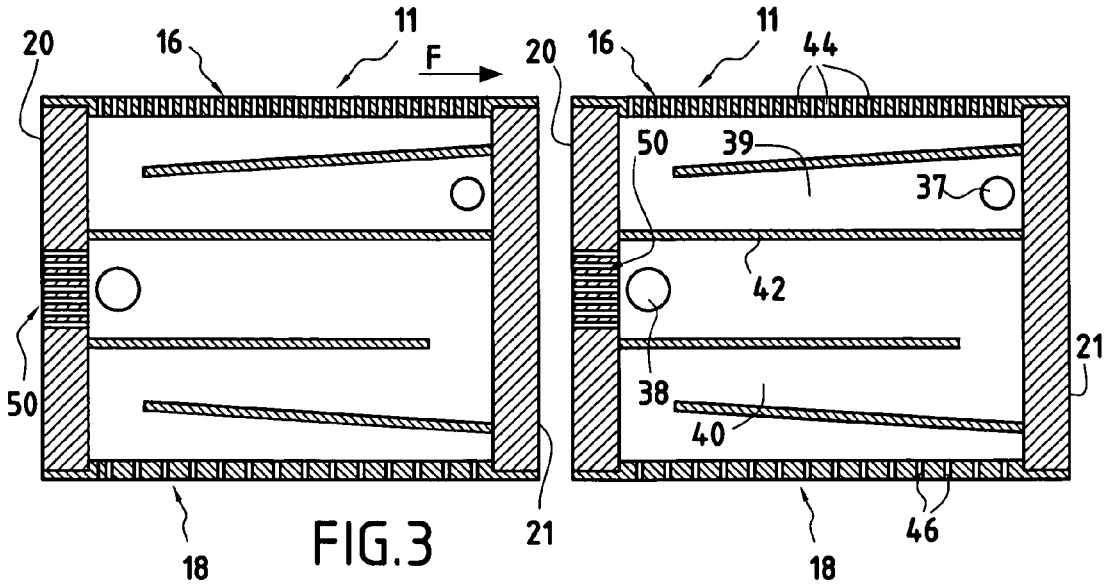
FIG.3

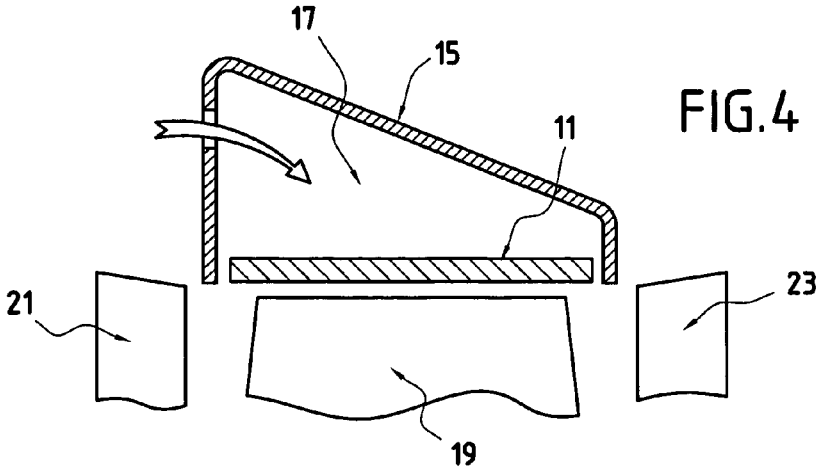
FIG.4
FIG.5
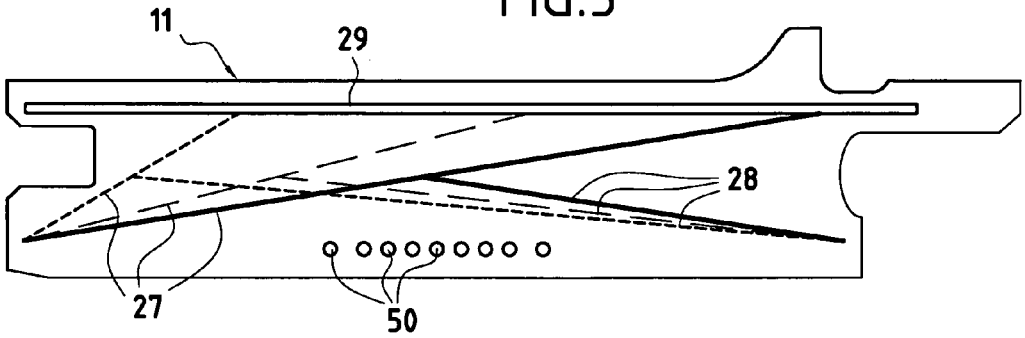
FIG.6
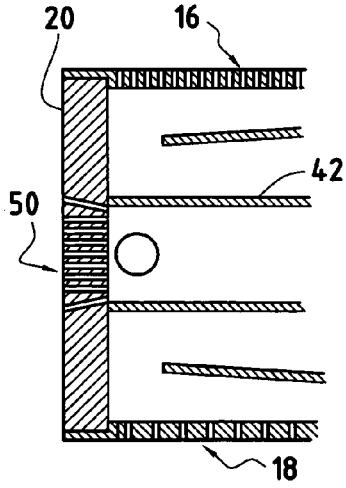
FIG.7
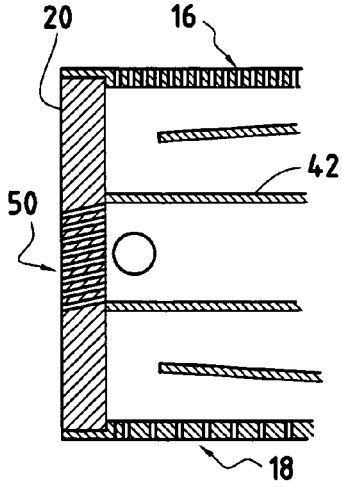
FIG.8
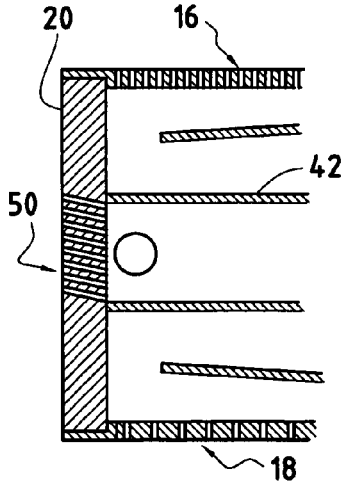

TURBINE RING

The invention relates to a turbine ring forming the outer shroud of the rotor of said turbine. The invention applies particularly to a high pressure turbine situated immediately downstream from the combustion chamber of an airplane turbojet. It relates more particularly to the interconnection and cooling of the sectors making up said turbine ring.

BACKGROUND OF THE INVENTION

In a turbine of the kind mentioned above, driven by gas at very high temperature, the rotor rotates inside a stationary turbine ring constituted by a plurality of curved sectors that are united end to end circumferentially in order to form the rotor shroud. The temperature of the gas driving the blade wheel is such that the thermomechanical stresses that are created between the sectors can lead to deterioration, reducing the lifetime of such rings. Typically, small cracks and/or flaking can often be observed on the inside (or "hot") face of the sectors, mainly in the vicinity of the connections between adjacent sectors.

To provide the ring with better sealing, reducing leaks of non-working air, and in order to prevent hot gas being reinserted, sealing systems are provided between such adjacent sectors, said systems comprising tongues that extend between the sectors and that are received in slots formed facing them in the adjacent radial faces of said sectors.

For example, a prior art sector 1 shown in FIG. 1 includes a sealing system comprising four tongues 2-5 received in slots 6, 7, and 8. The tongue 3 is bent and extends between two slots 6 and 7 that open out into each other and that receive the other tongues 2 and 4 which are straight. It is difficult to machine the slots accurately, in particular because of the difference in thickness needed to be able to insert the bent tongue. It is difficult to position this tongue properly. In addition, the tongue 2 is received entirely within a slot 6 that is parallel to the hot face 9 of the sector and that is close thereto. Unfortunately, the mere fact of forming the slot leads to stress concentration zones which, when situated close to a hot surface, weaken the part and accelerate deterioration thereof. The invention makes it possible to eliminate these drawbacks, in particular.

OBJECTS AND SUMMARY OF THE INVENTION

The invention thus provides firstly a turbine ring forming a rotor shroud, the ring being of the type constituted by a plurality of sectors interconnected end to end with interposed sealing systems comprising tongues extending between adjacent sectors, said tongues being housed in slots formed facing each other in adjacent radial faces of said sectors, wherein each sealing system is constituted by rectilinear tongues engaged in respective rectilinear slots in said radial faces.

The fact of making the sealing system from tongues that are straight simplifies making the slots and facilitates mounting the tongues therein. In addition, control over the positioning of the tongues is improved because of the bear against surfaces that are under better control since they are strictly linear. Overall, leakage sections are made smaller. A configuration with only three tongues is described below.

More particularly and advantageously, in the above-defined turbine ring, each sealing system comprises a first tongue and a second tongue extending in a chevron configuration on the inside of said radial faces, said tongues being engaged in rectilinear slots of said radial faces defining their relative positions accurately. As a result, air leakage between two consecutive sectors can be accurately calibrated. Such leakage can thus be identical through all of the inter-sector spaces. Overall, it is estimated that the leakage rate can be reduced by 10% to 20% compared with the above-described prior art configuration.

Another advantage of the invention lies in the fact that arranging the tongues in a chevron configuration on the hot face side makes it possible both to move the stress concentration zones further away from said hot face (since the slots go away therefrom), and also to provide sufficient space between the tongues and the hot face to allow cooling air ejection channels to open out therein, which channels are fed from a cavity formed within the sector itself.

More precisely, the invention also provides a turbine ring as defined above in which each sector includes a cooling air flow cavity, the ring further including air ejection channels extending between said cavity and at least one radial face of the sector, these channels opening out in said radial face between an inner edge thereof and said first and second tongues.

BRIEF DESCRIPTION OF THE DRAWINGS

The invention will be better understood and other advantages thereof will appear more clearly in the light of the following description given purely by way of example and made with reference to the accompanying drawings, in which:

FIG. 1 shows a radial face of a sector used in building up a prior art turbine ring;

FIG. 2 shows a radial face of a sector used in building up a tongue ring in accordance with the invention;

FIG. 3 is a diagrammatic view showing two consecutive sectors seen looking along III in FIG. 2;

FIG. 4 is a diagrammatic view of the casing associated with such ring sectors;

FIG. 5 is a diagrammatic view showing the various possible orientations for said first and second tongues; and FIGS. 6 to 8 are fragmentary views showing variants of one of the sectors shown in FIG. 3.

MORE DETAILED DESCRIPTION

In the drawings, and more particularly in FIGS. 2 to 4, there can be seen turbine ring sectors 11 constituting the stationary shroud of a rotor (not shown), specifically a rotor in the high pressure turbine of a turbojet. This turbine is located downstream from the combustion chamber. Specifically, such a ring is made up of thirty-two curved ring sectors 11 such as those shown, disposed end to end to form a slightly conical shroud surrounding said rotor. Each sector 11 is constituted by a slightly curved thick plate so as to build up the ring. There is a substantially rectangular inside face 12 that is slightly concave and that is referred to as the "hot" face since it comes into contact with the stream of hot gas, and a substantially rectangular outer face 14 referred to as the "cold" face. Relative to the flow direction of hot gas passing through the rotor, there is also an inlet edge 16 facing the combustion chamber nozzle, and an opposite outlet edge 18. Each sector 11 also has two radial faces 20 and 21 via which it is connected circumferentially to the adjacent sectors via sealing systems 26 (see FIG. 2) as mentioned above. Each sealing system 26 is constituted by a set of tongues engaged in corresponding slots defined in said facing radial faces 20, 21. Each tongue is engaged in two slots belonging to two circumferentially-adjacent ring sectors.

The tips of the rotor blades travel past the inner surface of the ring as constituted in this way. The direction of rotation is represented by arrow F in FIG. 3. The hot gas expelled from the combustion chamber thus flows close to the inside surface of the ring, which must therefore withstand very high temperatures. It is therefore necessary both to minimize temperature gradient within the structure of the ring as much as possible (thereby minimizing in particular leakages of gas between the sectors), and also to cool said ring effectively. For this purpose, use is made of a fraction of the air delivered by the compressor feeding the combustion chamber. To do this, each sector 11 is hollow and includes a cooling air flow cavity 35 fed from the outside.

FIG. 4 is a highly diagrammatic view showing the position of the ring made up from the set of sectors 11. A turbine casing 15 co-operates with the ring to define an annular cavity 17. The assembly extends radially outside the high pressure bladed wheel 19, itself interposed axially between the high pressure nozzle 21 and the low pressure nozzle 23. Air coming from the compressor is taken from a point upstream of the combustion chamber and penetrates (via holes) into the annular cavity 17. This cavity thus feeds all of the sectors in the ring. Each ring sector (FIG. 3) has two distinct cavities 39 and 40 of zigzag shape, separated by a partition 42, and fed via respective orifices 37 and 38. The air flowing in the cavity 39 escapes via a series of ejection channels 44 opening out in the inlet side 16 of the ring sector, while the air which flows in the cavity 40 escapes via a series of ejection channels 44 opening out in the outlet side 18 of the ring sector.

Apart from the sealing systems between the sectors, the arrangement described above is already known. The invention relates in particular to an advantageous improvement in said sealing systems between the sectors.

More particularly (FIGS. 2 to 4), each sealing system 26 is constituted in this case by three rectilinear tongues engaged in respective rectilinear slots in the radial faces of two adjacent sectors. Specifically, each sealing system (FIG. 2) comprises a first tongue 27 and a second tongue 28 situated on the insides of said radial faces, i.e. beside the hot faces of the sectors. The tongues 27 and 28 are arranged in a chevron configuration, i.e. they are engaged in slots 31 and 32 in said radial faces that extend at an angle relative to the inner and outer faces 12 and 14 of the sectors. These slots define the relative positions of the two tongues.

In addition, each sealing system includes a third tongue 29 extending substantially from one end to the other of the adjacent sectors, parallel to the axis of the ring and on the outer side of said radial faces. The tongue 29 is engaged in rectilinear slots 33 in the adjacent sectors. As can be seen in FIG. 2, the first tongue 27 extends between a point A situated close to the inlet side of the two sectors close to the inside (i.e. close to the hot faces) and a point B situated close to the third tongue 29. The second tongue 28 is positioned so as to extend between a point C situated close to the outlet side 18 of each of the sectors close to the inside and a point D situated close to the first tongue, substantially between the middle and a two-thirds point therealong starting from point A.

The pressures which become established in the spaces between the sectors on the inside and on the outside, and also between the third tongue and said first and second tongues taken together are such that said first and third tongues 27, 29 are pressed against the inside faces of the slots 31, 33 in which they are received, while said second tongue 28 is pressed against the outside faces of the slots 32 in which it is received, as can be seen in FIG. 2.

The length of the first tongue 27 depends on the angle it makes with the first tongue 29. Once this angle has been determined (several possibilities are shown in FIG. 5), the position and the length of the second tongue can be derived therefrom.

The angle defined between the first and third tongues may lie in the range 15° to 70°, approximately.

The slots can be machined accurately and they are well located. The tongues can be inserted in these slots and their relative positions can be well controlled. As a result the leakage section between said first and second tongues (at $S_1$) and the leakage section between the first and third tongues (at $S_2$) are well controlled.

With reference more particularly to FIGS. 2 and 3, another advantageous feature of the invention can be seen concerning the cooling of the radial faces 20 and 21 with air from the cooling air flow cavity 35. It can be seen that each sector has air ejection channels 50 extending between the cavity 40 and at least one radial face of the sector. These channels open out in the radial face 20 between its inside edge (hot face) and said first and second tongues 27, 28. The chevron configuration of these two tongues leaves room to form these air ejection channels. These channels are disposed in a row parallel to the axis of the ring. In the example of FIG. 3, they all extend perpendicularly to the radial face. In the example of FIG. 6, some of the channels 50 extend perpendicularly to the radial face while others situated at the ends of said row, or at least one of them, are at an angle diverging from the others, on going from the cavity towards the radial face. The angle between the diverging channels may lie in the range 10° to 120°. In certain circumstances, channels could be provided at angles that converge in the opposite direction. In the variant of FIG. 7, the channels are parallel and form an angle relative to a direction perpendicular to the radial face. The angle is such that the air is ejected with a component directed towards the rear of the ring. In the variant of FIG. 8, the channels are parallel and make an angle relative to a direction perpendicular to the radial face. The angle is such that the air is ejected with a component directed towards the front of the ring.

In the example, the channels 50 open out it the radial face 20 that is the first face to be reached by the blades, given the direction of rotation represented by arrow F. This is favorable for avoiding or limiting any reintroduction of hot gas into the inter-sector spaces. It would also be possible to make similar channels through the opposite wall, opening out in the radial face 21. The air escaping from the channels 50 cools the wall through which they are formed by convection (thermopumping), while the opposite wall (face 21) is cooled by the impact of the jets of air. In addition, the jets of air escaping from the channels 50 set up a kind of fluidic system preventing hot gas being ingested.

It should also be observed that the slots 31, 32, and 33 are preferably independent, i.e. they do not communicate with one another. This avoids any need to make any tool clearance at the junction between two slots. Leakage sections between the sectors are also reduced.

The invention also provides any ring sector or any assembly of ring sectors presenting the characteristics described above.

What is claimed is:

1. A turbine ring forming a rotor shroud, the ring comprising a plurality of sectors, each sector having an inside face in contact with a stream of hot gas, said sectors being interconnected end to end with interposed sealing systems comprising tongues extending between adjacent sectors, said tongues being housed in slots formed facing each other in adjacent radial faces of said sectors, wherein each sealing system includes rectilinear tongues engaged in respective rectilinear slots in said radial faces, and wherein the slots formed in each radial face are independent such that said slots do not communicate with each other, wherein each sealing system between two sectors comprises first and second tongues, and wherein said second tongue extends from a first end point situated close to an outlet edge of each sector, towards the inside, to a second end point situated close to said first tongue, said second end point being substantially between the middle of said first tongue and a two-thirds point starting from an end point of said first tongue close to an inside face of said sector.

2. A turbine ring according to claim 1, wherein each sealing system between two sectors comprises first and second tongues extending in a chevron configuration from the insides of said radial faces, said tongues being engaged in slots in said radial faces defining their relative positions.

3. A turbine ring according to claim 2, wherein each sealing system includes a third tongue extending substantially from one end to the other of the adjacent sectors, parallel to the axis of the ring, and on the outside of said radial faces.

4. A turbine ring according to claim 3, wherein said first tongue extends between a point situated close to an inlet edge of each sector, towards the inside, and a point situated close to said third tongue.

5. A turbine ring according to claim 4, wherein the angle defined by the directions of said first and third tongues lies in the range 15° to 70°.

6. A turbine ring according to claim 1, wherein the facing slots of two adjacent radial faces of said sectors house a single tongue.

7. A turbine, including a ring according to claim 1.

8. A turbine ring according to claim 1, wherein said first and second tongues extend in a chevron configuration from the insides of said radial faces, said tongues being engaged in slots in said radial faces defining their relative positions.

9. A turbine ring according to claim 1, wherein each sector comprises an outer face, opposed said inside face, wherein said tongues are between said inner and outer faces.

10. A turbine ring according to claim 9, wherein each sealing system between two sectors comprises first, second and third tongues, said third tongue extending substantially parallel to said outer face, and said first and second tongues being located between said third tongue and said inner face.

11. A turbine ring forming a rotor shroud, the ring comprising a plurality of sectors interconnected end to end with interposed sealing systems comprising tongues extending between adjacent sectors, said tongues being housed in slots formed facing each other in adjacent radial faces of said sectors, wherein each sealing system includes rectilinear tongues engaged in respective rectilinear slots in said radial faces, and wherein the slots formed in each radial face are independent such that said slots do not communicate with each other, wherein each sealing system between two sectors comprises first and second tongues extending in a chevron configuration from the insides of said radial faces, said tongues being engaged in slots in said radial faces defining their relative positions; and wherein said second tongue extends from a first end point situated close to an outlet edge of each sector, towards the inside, to a second end point situated close to said first tongue, said second end point being substantially between the middle of said first tongue and a two-thirds point starting from an end point of said first tongue close to an inside face of said sector.

12. A turbine ring according to claim 11, wherein each sector having an inside face in contact with a stream of hot gas.

13. A turbine ring forming a rotor shroud, the ring comprising a plurality of sectors interconnected end to end with interposed sealing systems comprising tongues extending between adjacent sectors, said tongues being housed in slots formed facing each other in adjacent radial faces of said sectors, wherein each sealing system includes rectilinear tongues engaged in respective rectilinear slots in said radial faces, and wherein the slots formed in each radial face are independent, wherein each sector includes a cooling air flow cavity, wherein each sector includes air ejection channels extending between said cavity and at least one radial face of said sector, said channels opening out in said radial face between an inside edge thereof and said first and second tongues.

14. A turbine ring according to claim 13, wherein at least some of the channels extend substantially perpendicularly to said radial face.

15. A turbine ring according to claim 13, wherein the orifices of said channels are disposed in a row parallel to the axis of the ring.

16. A turbine ring according to claim 15, wherein channels situated at the ends of said row are formed at an angle and diverge relative to the other channels on going from the cavity towards the radial face.

17. A turbine ring according to claim 13, wherein each sealing system between two sectors comprises first and second tongues extending in a chevron configuration from the insides of said radial faces, said tongues being engaged in slots in said radial faces defining their relative positions.

18. A turbine ring according to claim 17, wherein each sealing system includes a third tongue extending substantially from one end to the other of the adjacent sectors, parallel to the axis of the ring, and on the outside of said radial faces.

19. A turbine ring according to claim 18, wherein said first tongue extends between a point situated close to an inlet edge of each sector, towards the inside, and a point situated close to said third tongue.

* * * * *